US010533395B2

(12) United States Patent
Rustad et al.

(10) Patent No.: US 10,533,395 B2
(45) Date of Patent: Jan. 14, 2020

(54) PRODUCTION ASSEMBLY WITH INTEGRATED FLOW METER

(71) Applicant: OneSubsea IP UK Limited, London (GB)

(72) Inventors: Rolf Rustad, Radal (NO); Alexandre Lupeau, Bønes (NO); Nick Simpson, South Croydon (GB)

(73) Assignee: OneSubsea IP UK Limited, London (GB)

( * ) Notice: Subject to any disclaimer, the term of this patent is extended or adjusted under 35 U.S.C. 154(b) by 239 days.

(21) Appl. No.: 15/416,848

(22) Filed: Jan. 26, 2017

(65) Prior Publication Data

US 2017/0211350 A1 Jul. 27, 2017

Related U.S. Application Data

(60) Provisional application No. 62/287,254, filed on Jan. 26, 2016.

(51) Int. Cl.
*E21B 33/035* (2006.01)
*E21B 33/076* (2006.01)
*E21B 34/04* (2006.01)

(52) U.S. Cl.
CPC ..... *E21B 34/04* (2013.01); *E21B 33/035* (2013.01)

(58) Field of Classification Search
CPC ..... E21B 33/035; E21B 33/076; E21B 34/04; E21B 47/10
See application file for complete search history.

(56) References Cited

U.S. PATENT DOCUMENTS 5,971,077 A * 10/1999 Lilley ..... E21B 33/035 166/348
6,405,604 B1 * 6/2002 Berard ..... G01F 1/74 73/861.04
6,460,621 B2 * 10/2002 Fenton ..... E21B 33/035 166/347
7,181,980 B2 2/2007 Wium
7,647,974 B2 * 1/2010 Fenton ..... E21B 33/035 166/338
7,704,016 B2 4/2010 Gransaether
7,908,930 B2 * 3/2011 Xie ..... G01N 22/00 73/861.04
8,011,436 B2 * 9/2011 Christie ..... E21B 33/038 166/338
8,065,923 B2 * 11/2011 Duhanyan ..... G01F 1/74 73/861.04
8,151,890 B2 * 4/2012 Spencer ..... E21B 33/035 166/250.01
8,220,535 B2 * 7/2012 Donald ..... E21B 33/03 166/91.1
8,550,170 B2 10/2013 McHugh et al.
8,997,876 B2 4/2015 McHugh et al.
9,057,252 B2 * 6/2015 Bell ..... E21B 49/086
9,428,981 B2 * 8/2016 Hosie ..... E21B 33/038
10,174,575 B2 * 1/2019 Donald ..... E21B 33/076
2010/0132800 A1 * 6/2010 Jamaluddin ..... E21B 43/01 137/2

(Continued)

FOREIGN PATENT DOCUMENTS

WO WO-2013126592 A9 * 7/2014 ..... E21B 34/02

*Primary Examiner* — Matthew R Buck

(57) ABSTRACT

A production assembly comprising a valve, a flow meter and a choke as part of a branch of a production tree.

16 Claims, 4 Drawing Sheets

(56) References Cited

U.S. PATENT DOCUMENTS

| | | | | |
|---|---|---|---|---|
| 2011/0139460 | A1* | 6/2011 | Selstad | E21B 43/01 166/344 |
| 2014/0116716 | A1* | 5/2014 | Vincent | E21B 43/01 166/351 |
| 2016/0290841 | A1* | 10/2016 | Cadalen | G01F 1/58 |

* cited by examiner

PRODUCTION ASSEMBLY WITH INTEGRATED FLOW METER

BACKGROUND

To meet the demand for natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a completion system that includes a high pressure wellhead assembly through which the resource is extracted. These completion systems may include a wide variety of components, such as various casings, hangers, valves, fluid conduits, and the like, that control drilling and/or extraction operations.

One type of completion assembly includes a high pressure wellhead housing ("wellhead") with one or more strings of casing supported by casing hangers in the wellhead. Attached to the wellhead may be a tubing spool with a tubing hanger secured to a string of tubing that lands in the tubing spool above the wellhead. The tubing spool may have a plurality of vertical passages that surround a vertical bore. The vertical fluid passages provide access through the tubing spool for hydraulic fluid or electrical lines to operate and control equipment located downhole, such a safety valves or chemical injection units. Electrical and/or hydraulic control lines may extend alongside the outside of the tubing to control downhole valves, temperature sensors, and the like. A production tree is then installed on top of the tubing spool. The production tree has a vertical bore that receives upward flow of fluid from the tubing string and wellhead.

A production tree usually contains at least two valves enabling or preventing flow from the well into a flow line. It is known to have two gate valves in series on a horizontal branch of the tree for this purpose: the first may be called the production master valve (PMV), and the second may be called the production wing valve. Further, there might be a choke valve controlling the flow from the tree into the flow line.

It might be desirable to measure the production out of the production tree. For this purpose one man might place a multiphase or wet gas flow meter in the process flow line somewhere between the wellhead and a commingling point.

BRIEF DESCRIPTION OF THE DRAWINGS

For a detailed description of the preferred embodiments of the invention, reference will now be made to the accompanying drawings in which.

DETAILED DESCRIPTION

Figure 1:
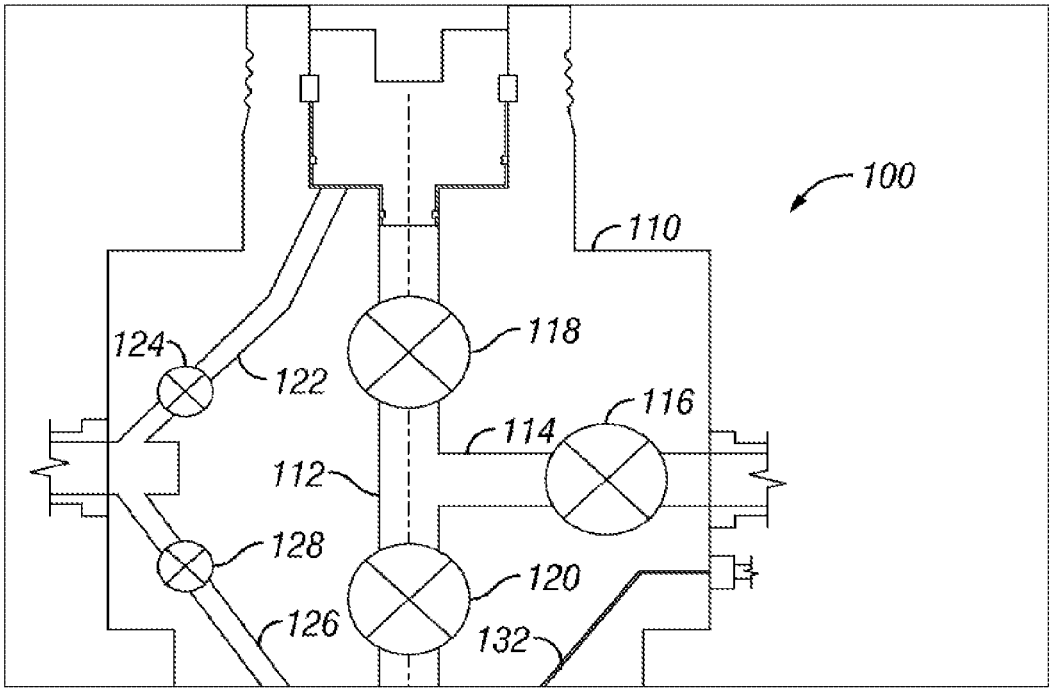
FIG. 1. shows a schematic cross-sectional view of a portion of a known completion system for a well.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components. The use of "flow meter" is meant to identify any multiphase or wet gas flow meters, or single phase flow meters, or multiphase meters.

Disclosed herein is a production assembly for a well that may include and/or be used with a production tree. The production tree may be subsea, and may include conventional (e.g., vertical), horizontal, dual bore, mono bore, and hybrid trees. The production tree may be installable on other components of the subsea completion system, such as installable on a tubing spool.

Referring now to FIG. 1, a cross-sectional view of a portion of a known completion system 100 for a well is shown. As discussed above, the completion system 100 may be subsea, such as when used with a subsea well. The completion system 100 may include a production tree 110, such as a vertical subsea production tree as shown. The production tree 110 may include a main production bore 112 formed therethrough with a wing bore 114 intersecting with and extending from the main production bore 112 to form a branch of the production tree 110. The wing bore 114 may include one or more valves in fluid communication therewith to continue the branch, such as a production outlet valve (POV) 115 and a wing valve 116 in a production wing valve block 117 that may be used to control the flow of fluid through the wing bore 114. The production valve block 117 includes a wing bore 119 in line with and extending from the wing bore 114.

Further, the production tree 110 may include one or more valves in fluid communication therewith, such as a production swab valve 118 and/or a production master valve (PMV) 120 in fluid communication with the main production bore 112 to control the flow of fluid through the main production bore 112. For example, the production swab valve 118 may be included within the main production bore 112 above the intersection of the main production bore 112 and the wing bore 114, and the production master valve 120 may be included within the main production bore 112 below the intersection of the main production bore 112 and the wing bore 114. Although there is a production master valve 120 in the main production bore 112, either the POV 115 or the wing valve 116 in the branch of the tree 110 may also function as a PMV, for example, when equipment is passing through the PMV 120.

The production tree 110 may include one or more auxiliary passages, such as an annulus flow path, that is formed within the production tree 110 and outside of the main production bore 112 (e.g., out of fluid communication with the main production bore 112). For example, as shown, the production tree 110 may include an upper auxiliary passage 122 with an upper valve 124 in fluid communication with the main production bore 112 above the intersection with the wing bore 114 and/or may include a lower auxiliary passage 126 with a lower valve 128 in fluid communication with the main production bore 112 below the intersection with the wing bore 114. As shown, the upper auxiliary passage 122 may be in fluid communication with the lower auxiliary passage 126.

Further, in addition to the auxiliary passage, the production tree 110 may include one or more valve control passages, such as a valve control passage 132 formed therethrough and outside of the main production bore 112 and the auxiliary passage within the production tree 110. For example, the valve control passage 132 may be used to control one or more valves within the completion system 100.

According to embodiments of the disclosure, it is proposed an assembly wherein the wing bore 114 forms a branch of the production tree 110 that will enable measurement of the flow produced from the production tree 110. In an embodiment presented schematically on FIG. 2, one example assembly comprises a wing valve 116, a flow meter 140, and a choke 150 in series with each other in a branch of the production tree 110. Pipe spools or similar piping components may be placed between these individual components, without altering the integration of the flow measurement in the wing bore 114.

The wing valve 116 may be of various types. For example, the wing valve might be a gate valve, a ball valve, or any kind of valve suitable for the purpose. Similarly, various types of chokes 150 may be used. Further, the flow meter 140 may be a single, multiphase, or wet gas flow meter. In embodiments, the flow meter may combine a differential pressure measurement with one or several means to measure the fractions or hold ups of the various phases that may be present in the flow.

In embodiments of the disclosure, the flow meter comprises a differential pressure measurement, e.g. a venturi tube, and at least one way of measuring fractions, e.g. a multi-energy gamma fraction densitometer, unless it is a single-phase meter. The differential pressure measurement may have a first and a second pressure port. The flow meter may further have one or several electronics units for the purposes of gathering sensor data, performing calculations, and communicating with other systems such as a process control system or a subsea control system, not represented.

In embodiments of the disclosure, the flow meter comprises a venturi tube as the differential pressure measurement. Any kind of differential pressure measurement may be used, such as a V-Cone meter, an orifice plate, or any other type of differential pressure flow meter. In embodiments wherein the flow meter is a multiphase flow meter, the fraction measurement system might comprise a multi-energy gamma system. Any kind of fraction measurement may be used, including but not limited to gamma densitometry, capacitive methods, inductive methods, microwave methods, ultrasonic measurements, optical attenuation measurements, optical fraction measurements, tracer methods, among others.

Figure 2:
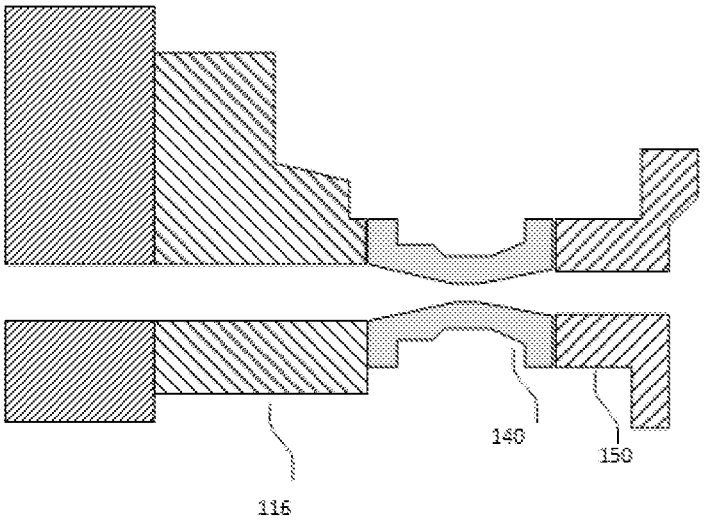
FIG. 2 shows a schematic cross-sectional view of an assembly that might be connected to a production tree in accordance with one or more embodiments of the present disclosure.

In an embodiment of the disclosure shown on FIG. 2, the production assembly comprises: a wing valve 116 connected as part of a branch of a subsea production tree (not show), a flow meter 140 connected to the wing valve and a choke 150 with a fluid exit connected to the flow meter 140. Because the flow meter 140 is located before the fluid exit of the choke 150, the flow meter 140 is integrated with the tree. For example, the flow meter 140 may be connected in such a manner so as to not be disconnectable without disconnecting the tree itself.

Figure 3:
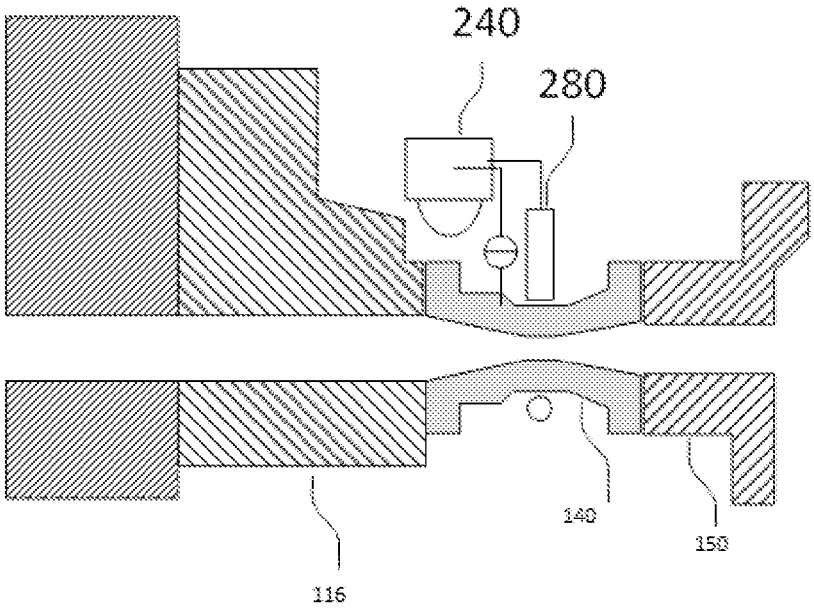
FIG. 3. shows a schematic cross-sectional view of an assembly that might be connected to a production tree in accordance with other one or more embodiments of the present disclosure.

In embodiments presented on FIG. 3, the production assembly of the disclosure comprises a wing valve 116, a flow meter 140 connected to the wing valve, the flow meter 140 having an electronics unit 240 removably attached to the assembly and a choke 150 connected to the flow meter.

Figure 4:
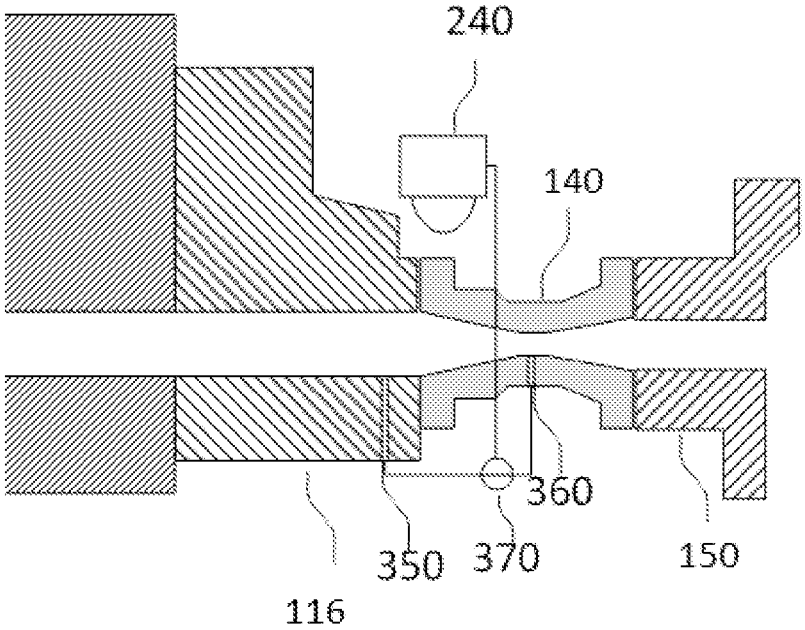
FIG. 4. shows a schematic cross-sectional view of an assembly that might be connected to a production tree in accordance with other one or more embodiments of the present disclosure.

In embodiments presented in FIG. 4, the production assembly of the disclosure comprises a wing valve 116 including a first pressure port 350, a flow meter 140 connected to the wing valve, the flow meter containing a second pressure port 360, a differential pressure measurement device 370 measuring the differential pressure between the two pressure ports for the purpose of flow measurement, and a choke 150 connected to the flow meter.

Figure 5:
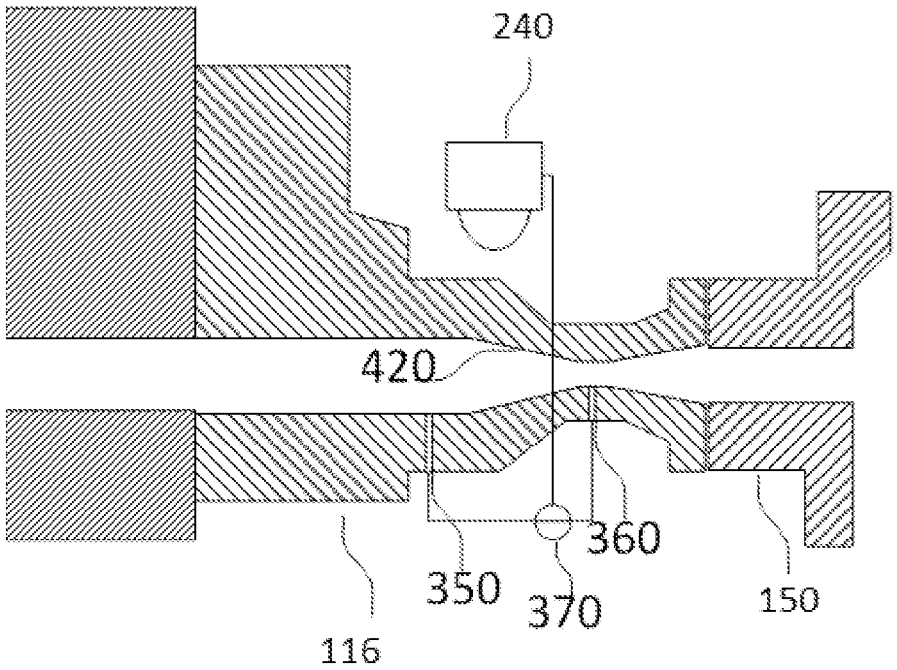
FIG. 5. shows a schematic cross-sectional view of an assembly that might be connected to a production tree in accordance with other one or more embodiments of the present disclosure.

In embodiments presented in FIG. 5, the production assembly of the disclosure comprises a wing valve 116 with an outlet comprising a flow path 420 suitable for differential pressure flow measurements, such as a venturi profile, and associated pressure ports 350 and 360, a differential pressure measurement device 370 measuring the differential pressure between the pressure ports for the purpose of flow measurement, and a choke 150 connected to the outlet of the wing valve. In embodiments, a multi-energy gamma system for performing fraction measurement, comprising a source and detector, might be connected directly into the wing valve 116 cavity with the fraction measurements taken directly in such area. Such arrangement might enable to further simplify the production assembly design while contributing to reduce the overall size of the production tree connected such assembly. Other types of fraction measurement systems may be used in the same area for the same purpose.

Figure 6:
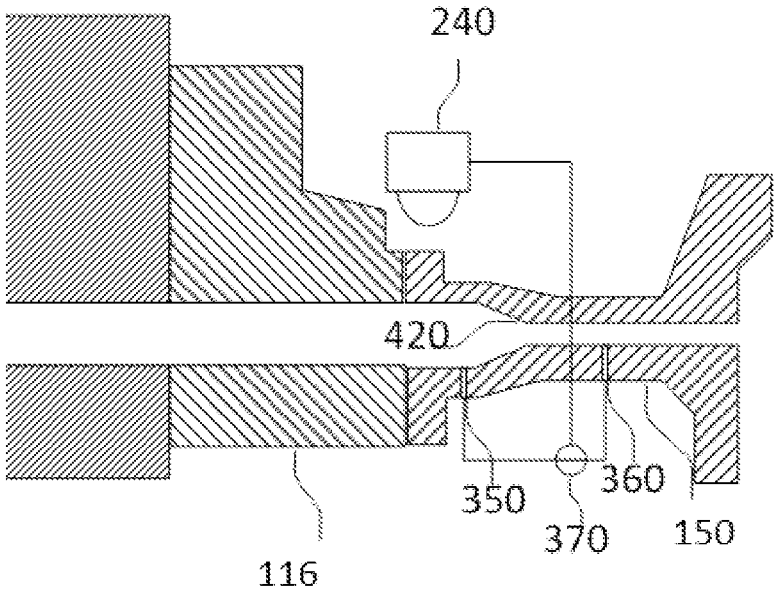
FIG. 6. shows a schematic cross-sectional view of an assembly that might be connected to a production tree in accordance with other one or more embodiments of the present disclosure.

In embodiments presented on FIG. 6, the production assembly of the disclosure comprises a wing valve 116 and a choke 150 with an inlet comprising a flow path 420 suitable for differential pressure flow measurements, such as a venturi profile, and associated pressure ports 350 and 360 and a differential pressure measurement device 370 measuring the differential pressure between the pressure ports for the purpose of flow measurement. In embodiments, a multi-energy gamma system for performing fraction measurement, comprising a source and detector, might be connected directly into the choke 150 with the fraction measurements taken directly in such area. Such arrangement might enable to further simplify the production assembly design while contributing to reduce the overall size of the production tree connected assembly. Other types of fraction measurement systems may be used in the same area for the same purpose.

Figure 7:
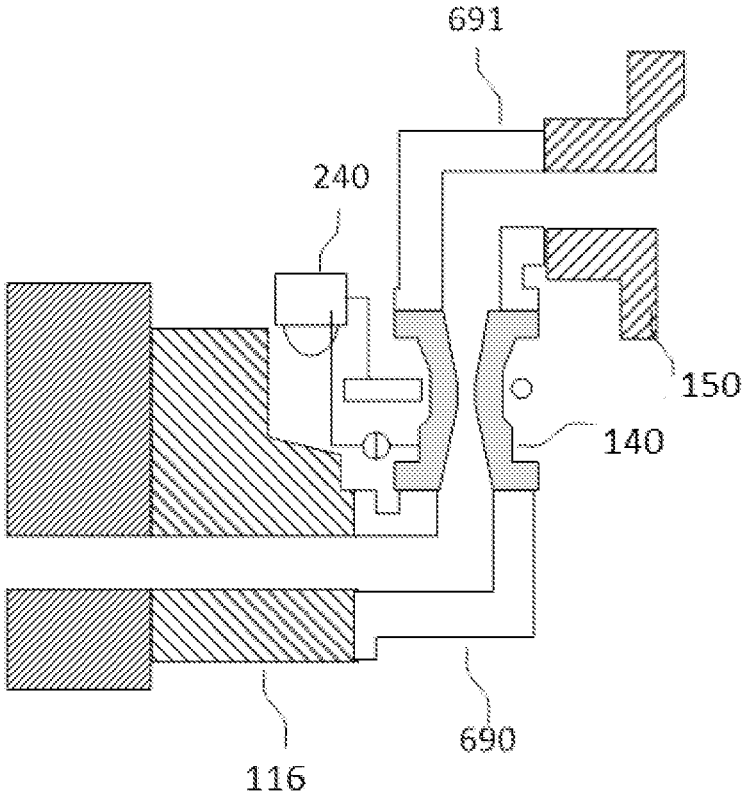
FIG. 7. shows a schematic cross-sectional view of an assembly that might be connected to a production tree in accordance with other one or more embodiments of the present disclosure.

In embodiments presented on FIG. 7, the production assembly of the disclosure comprises a wing valve 116, a first conduit 690 turning the flow direction from horizontal to vertical, a flow meter 140 connected to the first conduit, a second conduit 691 turning the flow direction from vertical to horizontal, a choke 150 connected to second conduit. In this embodiment the vertical flow direction may be vertical up or vertical down.

Any of the embodiments may also include a fraction measurement device 280 as shown in FIG. 3 and/or include a retrievable electronics unit 240 as also shown in FIG. 3.

Although the present invention has been described with respect to specific details, it is not intended that such details should be regarded as limitations on the scope of the invention, except to the extent that they are included in the accompanying claims.

What is claimed is:

1. A production assembly comprising a production tree for producing a fluid from a well and comprising a branch with a bore, the branch further comprising a valve, a choke with an exit for the fluid, and a first and a second pressure port in a valve body of the valve or in a choke body of the choke, wherein the production tree is a subsea tree, the valve body or the choke body includes the first and the second pressure ports and an internal venturi profile such that the valve body or the choke body incorporates a flow meter having the first and the second pressure ports and the internal venturi profile located before the exit of the choke and in communication with the bore, and the flow meter is integrated with the tree such that the flow meter is non-retrievable from the tree with the tree installed subsea at the well.

2. The production assembly of claim 1, wherein the valve body incorporates the flow meter.

3. The production assembly of claim 1, wherein the choke body incorporates the flow meter.

4. The production assembly of claim 1, wherein the valve, the choke, and the flow meter are arranged along the bore in series.

5. The production assembly of claim 1, wherein the flow meter comprises a multi-phase flow meter and the assembly further comprises a fraction measurement system in communication with the bore and configured to measure fractions of the various phases that may be present in the fluid flowing through the bore.

6. The production assembly of claim 1, further comprising an electronics unit in electrical communication with sensors and other systems and comprising a processor, the electronics unit being configured to receive and perform calculations using data from the sensors and communicate data with the other systems.

7. The production assembly of claim 6, wherein the electronics unit is retrievably attached to the flow meter or the production tree.

8. The production assembly of claim 1, the assembly further comprising a differential pressure measurement device in communication with and configured to measure a differential pressure between the first and second pressure ports.

9. A method of measuring flow from a production assembly comprising a production tree, the method comprising flowing fluid through a bore of a branch of the tree including a valve, a choke, and a first and a second pressure port in a valve body of the valve or in a choke body of the choke, wherein the valve body or the choke body includes the first and the second pressure ports and an internal venturi profile such that the valve body or the choke body incorporates a flow meter having the first and the second pressure ports and the internal venturi profile located before an exit of the choke and in communication with the bore; and measuring via the flow meter the flow of the fluid through the bore of the branch before the fluid exits the choke;

the method further comprising installing the production tree subsea at a well with the flow meter integrated with the tree such that the flow meter is non-retrievable from the tree with the tree installed subsea.

10. The method of claim 9, wherein the valve body incorporates the flow meter.

11. The method of claim 9, wherein the choke body incorporates the flow meter.

12. The method of claim 9, wherein the flow meter comprises a multi-phase flow meter and the method further comprises measuring fractions of the various phases that may be present in the fluid flowing through the bore with a fraction measurement system.

13. The method of claim 9, wherein the method further comprises measuring a differential pressure between the first and second pressure ports with a differential pressure measurement device.

14. A branch for a production tree for producing a fluid from a well, the branch comprising a bore and further comprising a valve, a choke with an exit from the branch for the fluid, and a first and a second pressure port in a valve body of the valve or in a choke body of the choke, wherein the valve body or the choke body includes the first and the second pressure ports and an internal venturi profile such that the valve body or the choke body incorporates a flow meter having the first and the second pressure ports and the internal venturi profile located before the exit of the choke and in communication with the bore, and wherein the valve, the flow meter, and the choke are connected in series such that the bore extends linearly through the valve and the flow meter into the choke.

15. The branch of claim 14, wherein the valve body incorporates the flow meter.

16. The branch of claim 14, wherein the choke body incorporates the flow meter.

* * * * *